US005830378A

United States Patent [19]

Butler

[11] Patent Number: 5,830,378

[45] Date of Patent: Nov. 3, 1998

[54] CONCRETE SLAB FOUNDATION FORMING DEVICES

[76] Inventor: Michael G. Butler, 31078 Turner Rd., Fort Bragg, Calif. 95437

[21] Appl. No.: 600,408

[22] Filed: Feb. 12, 1996

Related U.S. Application Data

[63] Continuation-in-part of Ser. No. 398,356, Mar. 3, 1995, abandoned, which is a continuation-in-part of Ser. No. 299,474, Aug. 29, 1994, Pat. No. 5,564,235.

[51] Int. Cl.[6] ..... E04G 11/00

[52] U.S. Cl. ..... 249/18; 249/3; 249/13; 249/210

[58] Field of Search ..... 249/3, 4, 5, 6, 249/7, 13, 18, 210

[56] References Cited

U.S. PATENT DOCUMENTS

| | | | |
|---|---|---|---|
| 1,512,165 | 10/1924 | Funkhouser | 249/6 |
| 2,731,700 | 1/1956 | Yates | 249/7 |
| 2,846,749 | 8/1958 | Yates et al. | 249/7 |
| 3,378,968 | 4/1968 | Shoemaker | 249/3 |
| 4,533,112 | 8/1985 | Santos, Jr. et al. | 249/3 |

*Primary Examiner*—David W. Wu
*Attorney, Agent, or Firm*—Fuess & Davidenas

[57] ABSTRACT

An assemblage which forms in-situ monolithic concrete slab-on-grade foundations is an internally collocating monolithic forming unit, which unit is typically light weight enough to be maneuvered intact. The unit is comprised of a number of form members and an overhead screed. The concrete-surface-defining form members, preferably sections of light-gage cold-formed metal, also serve as struts defining foundation horizontal geometry by having controlled lengths and interconnections. Corresponding pairs of squaring wires control geometry as well, and are removed before finishing the concrete slab. Temporary support of the forming unit is upon coarsely threaded stakes. Each stake screws into earth with a high speed pneumatic impact wrench, and quickly secures simple form support components such as a slab clip. Resulting connections provide subsequent adjustment of any form member independently, or the entire forming unit simultaneously, in any direction or rotation before securing it into place, and pouring a slab on grade foundation.

9 Claims, 3 Drawing Sheets

CONCRETE SLAB FOUNDATION FORMING DEVICES

REFERENCE TO RELATED PATENT APPLICATIONS

The present patent application is a continuation-in-part of U.S. patent application U.S. patent application Ser. No. 08/398,356 filed on Mar. 3, 1995 now abandoned for CONCRETE FOUNDATION WALL FORMING DEVICES, which application is itself a continuation-in-part of U.S. patent application Ser. No. 08/299,474 filed Aug. 29, 1994 now U.S. Pat. No. 5,564,235 for a FOUNDATION AND FLOOR CONSTRUCTION MEANS. Both related predecessor applications are to the selfsame Michael Butler who is the inventor of the present application. The contents of the related predecessor patent applications are incorporated herein by reference.

BACKGROUND OF THE INVENTION

1. Field of the Invention

The present invention generally concerns improvements in the practice of constructing a monolithic in-situ concrete slab foundation and in related concrete work.

The present invention particularly concerns a construction form system, a stake for use in construction, a method of making a slab on grade foundation, a device for connecting a construction form to stakes, and a skirt for a construction form.

2. Description of the Prior Art

While much prior art can be found in the field of slab foundations and related concrete work, the commercial success of contemporary proprietary systems which form a concrete-slab-on grade is limited. The primary reasons for this are that the proprietary systems tend to be expensive, contrived, and inflexible. Furthermore, forming a concrete slab on a prepared building pad is not a significant engineering feat, and so is generally endeavored with simple boards and stakes.

The board and stake concept offers design flexibility, but it does have significant drawbacks. These drawbacks include: wasted labor to define and check geometry, poor accuracy of surfaces and embedded hardware, difficulty in adjusting form locations after stakes are set, and inconsistent repeatability for multiple units. Back injury, caused by pulling a conventional stake out of the ground, is a common complaint in the foundation business. Poor foundation accuracy is always a concern, and it has a more consequential negative affect on the framing process for a structure of light gage metal members. This is because the framing assemblages of these members tolerate little dimensional error at the points of support.

Established proprietary concrete forming systems include such ones as 'Metaform', which are of folded sheet metal. Lengths are generally in 10' increments, which is the length of the brake that folds the sheet metal. For a long run of perimeter form this results in frequent potential segmental kinks. Conforming to custom dimension and design requires the cutting up of relatively expensive lengths of form. Stakes must be placed only at specific holder locations provided on the forms, and no subsequent relative horizontal adjustment is possible. If a rock or obstruction happens to be at one of these specific locations, then one must compromise either form location or stake support.

Solutions addressing the need to adjust forms relative to stakes include the system disclosed in Canadian patent 1,145,179 by Breitenbach, issued 1983, Apr. 26. This apparatus allows adjustment of form location subsequent to setting of stakes, by a system of supporting yokes consisting of bars, sleeves, and brackets. This type of a solution involves one or a pair of sets of moving parts for each direction of adjustment. Each supporting assemblage is subject to unwanted lateral movement due to the fact that the each of the supporting stake pairs are required to be essentially parallel for vertical adjustment of the yoke, which attaches to them above the forms. Stakes in loose soils simply do not hold up to this kind of side cantilever loading. Even bending of the stakes can be enough of a problem, given the relatively high point of attachment. Each of these assemblages is heavy, clumsy, relatively expensive, and an obstruction to the concrete work, especially for slab-on-grade foundations. There are too many parts to buy, clean, and maintain.

A somewhat simpler proprietary forming method offers subsequent adjustment in the vertical direction only. This is disclosed in U.S. Pat. No. 3,397,494, Waring, issued 1968, Aug. 20. With this system, vertical support to a proprietary perimeter member is provided with rods having machine thread. These rods thread into bearing pads that sit upon the earth, and then support the special cast in place perimeter member directly. No allowance is provided for rod location. It must be directly at a hole in the member, regardless of what local anomaly or rock may be at the ground below that point. The rod supports offer little resistance to uplift from the buoyant forces of concrete placement, because they do not have threads capable of threading into earth, and so are not used in that manner. This support offers essentially no lateral force resistance. In fact, the system requires a redundant conventional perimeter form board with conventional stakes, et cetera, for structural stability. The main purpose of the present invention is to provide placement of a cast in-situ foundation perimeter for a proprietary wall system which requires a special recessed ledge.

For slab-on-grade foundations, most contractors prefer to continue to form with simple boards and stakes, in spite of the drawbacks, because they do not impose a lot of contrivance, have a low initial cost, and provide flexibility in geometry. Those in the trades have grown to accept the challenges of building foundations with a most primitive technology. It is generally understood that foundation construction includes performing redundant efforts at determining geometry, having a difficult time making geometrical adjustments, and then getting complaints about accuracy from the people building the structure atop anyway. In truth, all of these problems really can be solved without forcing a lot of limitations and contraptions upon the foundation builder, as the following discussion will illustrate.

The objects and advantages of the present invention will shortly be seen to be as follows.

In order to evaluate a new foundation construction practice, it is sensible to first examine some contemporary needs of the industry.

Tract home builders most often build slab-on-grade foundations. Normally, a building pad is created for each unit. This pad is typically graded so as to completely facilitate slab-on-grade foundation construction. Identical unit footprints, and mirrored versions, are repeated often. The foundation forming method should effectively address this circumstance.

Homes built today tend to have more seismic hardware anchored in the foundation than earlier homes did. Increasingly, post-tension slab-on-grade foundations are being built in order to achieve economy at sites having expansive soil conditions. All of the post-tension anchors must be located correctly along the perimeter form, and in conjunction with the conventional hardware embedments. In general, more connections located in a tighter space demands more accuracy of the foundation forming method which locates these items. Additionally, the task of physically locating an element of hardware is performed very often. So, the task must be made to be as easy and repeatable as possible.

A growing number homes are being framed with members of cold-formed light-gage steel. The framing of these homes requires greater accuracy than most foundation contractors will deliver, particularly for the cost effective 'panelized' structures (the metal stud walls are framed in a shop and erected at site). For the increasingly common 'panelized' structure, a very accurate foundation, to the last hardware embedment, is required for cost effective Construction. For repeat units of 'panelized' homes, the accuracy must be such that entire buildings and foundations be considered as interchangeable parts, if true production building is to occur.

An important component of foundation accuracy is easy adjustment of location of foundation forms, so that needed adjustments are made rather than ignored. For custom built structures, provision for easy adjustment of foundation forms is significant. This is because, compared to repetitive construction, relatively far more labor tends to be expended on the custom geometry definition. So, the ability to have adjustment after forms are initially set up, provides a big labor savings for even one unit. It is best if all the foundation form support locations can be adjusted simultaneously. This way an entire lightweight forming unit, which is internally collocating, can be assembled whole, floating on supports, before being committed to the exact permanent placement.

Most contemporary post-tension slab-on-grade foundation construction is built on a flat-graded earth pad without trenches. This increasingly popular method requires no lay out of trenches, so a foundation forming method which does not require the lay out of any geometry at all, can provide significant labor-saving benefit to the foundation construction process.

The present invention provides the fastest means possible of constructing a concrete slab foundation. The process is more convenient and less injurious than conventional methods. The investment is less and the utility more diverse than with other proprietary methods. The results are more reliable and accurate. Components of the present invention offer novel utility independently, and with elements of co-pending patent applications, they offer substantial benefit for other types of foundations.

The present invention utilizes the increasingly available light-gage roll-formed steel members as concrete forms. They are low cost, light-weight, and are supplied in any desired lengths. These standardized "C" shaped sections are supported by exceptionally simple components which allow subsequent adjustment of forms relative to stakes, in all three orthogonal directions.

Other elements of the present invention combine with the form members to create a collocating-upon-assembly forming unit for an entire slab foundation. This forming unit may be assembled while floating on supports, and then adjusted into place. It can be built to be light-weight enough to allow a crew to carry it whole from unit to unit, as if it were a large cookie cutter.

With the present invention, adjustments to form locations are facilitated by the use of coarsely threaded rods which offer support directly. This is because the same adjustment rods which connect to form components, also thread directly into the earth. Threading into earth improves resistance to buoyant forces from concrete placement, and thus facilitates use of light-weight forms. The threaded stakes may also be angled outward so as to buttress the forms directly. They are much easier to get into and back out of the ground than conventional stakes are. Threaded stakes offer significant improvements to the construction of most any type of in-situ concrete foundation.

The present invention requires less labor than any other method to build a concrete slab foundation. It will please any builder with the inherent, repeatable accuracy. Elements of the present invention provide labor-saving and quality-enhancing utility for most kinds of foundations.

SUMMARY OF THE INVENTION

The present invention contemplates (i) a construction form system for easily and efficiently making a slab on grade foundation upon the surface of the earth, (ii) an easily set and easily extracted strong stake suitable for general use in construction, (iii) a method of making a slab on grade foundation characterized by a fast and easy, repetitive, setup, (iv) a quick-acting device for connecting and holding a construction form to stakes precisely and accurately at any arbitrary position, and (v) a skirt for a construction form that releases quickly and easily from a poured and set foundation made with the construction form.

1. A Construction Form System

In first aspect and embodiment as a construction form system, the system of the present invention includes a construction form that is capable of being assembled and thereafter move intact over and upon the earth. The construction form has and presents (i) a substantially planar face to its interior and (ii) a substantially contiguous peripheral "C"-channel to its exterior.

In accordance with the present invention, a new collocating sub-system is used to conveniently, easily, quickly, accurately and precisely spatially locate and hold this construction form above the earth. The sub-system is based on several cooperatively interactive parts.

A number of bent-planar-elements twist slightly about an imaginary horizontal axis so as to engage and hold the construction form at its peripheral exterior "C" channel. These bent-planar-elements are preferably in the substantial form of bent plane having (i) a length, and (ii) a cross section, orthogonal to an axis of the length, that is topologically equivalent to a "U" with a substantially central trough and two flanges. Each of the two flanges has at its furthest extent a feature that is complimentary to fit within, and to engage, the "C"-channel of the construction form. When so engaged the bent-planar-element extend across the width of the "C"-channel, and across the width of the construction form of which the "C"-channel is a part.

A large number of elongate metal stakes—tapered (typically to a sharp point) on one end while presenting a feature for coupling rotational forces on the other end while threaded in the middle—are conveniently located—normally by being screwed into the earth by hand-held power torque wrench—at the external periphery of the sited construction form. A first group of the stakes are each so screwed into the earth roughly vertically through an aperture formed by the "U" cross-section of a bent planar element and the exterior of the construction form engaged (at its "C" channel) by this bent planar element. Meanwhile, preferably yet another, second, group of the stakes are screwed into the earth at an incline so as to approximately intersect the approximately vertical first group of stakes at spatial regions above the earth, and above the bent planar elements. The stakes are typically cut and formed in 0.6 meter to 1.8 meter lengths from steel coil rod.

A number of first assemblies both slip and thread the substantially vertical stakes of the first group so as to ultimately be held by threaded engagement with these stakes at selected heights that are suitable to collocate and to hold the bent planar elements, and thus also the construction form that the bent planar elements engage, level above the earth. These first assemblies preferably consist of a number of nuts and open-channeled "hairpin" bars. The nuts slide over the top of the featured end regions of the first group of stakes, and thread a threaded middle region of the stakes. The open-channeled "hairpin" bars slip over and along the stakes until coming to rest against a nut. The bars serve to increase the effective external diameter of the nut.

Because the bent-planar-elements are, as previously stated, preferably in the substantial form of bent plane having (i) a length, and (ii) a cross section, orthogonal to an axis of the length, that is topologically equivalent to a "U" with a substantially central trough and two flanges, each of the two flanges serves, in conjunction with the engaged "C"-channel of the construction form, to present an aperture. A vertical stake of the first group is passed through this aperture and is threaded into the earth. Each of the bent-planar-elements is stopped and held by an associated one of the first assemblies, each at a position determined by this first assembly and its associated stake.

By this arrangement of parts, a vertical stakes is passed through a trough of a bent-planar-element. The bent-planar-element is subsequently stopped to the stake by the open-channeled bar and the nut. Thus stopped the bent-planar element serves to engage, and to hold, the foundation form at a localized region. The collective bent-planar elements, first assemblies and vertical stakes thus serve to support the foundation form level above the earth.

Remaining sub-system parts serve to accurately precisely adjust the supported foundation in direction (i.e., in angle of rotation in the level plane). A number of second assemblies slip and thread both the substantially vertical stakes and the associated inclined stakes so as to ultimately be held to, and between, these stakes by threaded engagement with both. These second assemblies are adjustable so as to move the upwards extension of the vertical stakes relative to the inclined stakes, and relative to the earth, so that the level construction form is adjusted in direction. Notably, the level support of the construction form above the earth by and on the bent-planar-elements, the first assemblies, and the vertical stakes both accommodates and permits this adjustment.

Opposite corners of the construction form may be connected with and by adjustable squaring wires in order to promote correct and square location of the sides of the construction form.

Accordingly, the construction form is conveniently, easily, quickly, accurately, and precisely spatially located and held above the earth. When a pourable construction material is poured into the construction form a slab on grade foundation is created. Each of the construction form, the vertical and inclined stakes, the bent-planar-elements, and the first and second assemblies may all be removed from the foundation of hardened pourable construction material, re-sited, and reused.

2. A Stake for Use in Construction

In another of its aspects the present invention is embodied in a stake suitable for use in construction. Such a stake consist of an elongate threaded metal member having (i) a length between 0.45 meter and 1.8 meter, (ii) a tapered (pointed) first end region that is suitable to be screwed into earth, and (iii) a second end region in the shape of a regular prism. The prism-shaped second end region is suitable to be engaged and to be rotated, turning the entire elongate threaded member, by a rotating tool, normally a hand-held power torque wrench. This second end region has a maximum diameter that is everywhere effectively less than a root diameter of the externally threaded middle region.

The thread of this middle region is both (i) deeply cut, having at a ratio of root diameter to outside diameter of typically less than 0.80, and (ii) steeply inclined, the threads having an incline of about 1 in 9.4. The steepest incline that will permit the nuts to remain tight is optimal for driving the stakes into dirt, and incline is preferably at least 1 in 20. Because the diameter of the second end region in the shape of a prism is everywhere effectively less than the root diameter of the externally threaded middle region, a threaded nut may be passed over the second end region in order to threadingly engage the middle region.

The stake is preferably made from a 0.6 meter to 1.8 meter (two foot to six foot) length of steel rod having a low root-to-major-diameter ratio, normally less than 0.5. Standard steel coil rod having an approximate diameter of 12 millimeters (0.075 inches) and approximately 6 threads each 25.4 millimeters is suitable. The stake's first end region is preferably tapered to a point over at least 1.9 centimeters (¾ inches) of length; a second end region is preferably formed to a regular prism over at least 1.3 centimeters (1/2 inch) of length; and the stake has and presents steeply inclined threads in substantially an entire middle region between the first and the second end regions. The second end region is preferably formed by milling to the shape of the regular prism, preferably a hexagonal prism, over at least 2.54 centimeters (1 inch) of length. The head may alternatively be formed by forging, again preferably in the shape of a regular prism. The head in the shape of a regular prism facilitate that a rotating tool engaging this second end head region may impart considerable torque to rotating the stake without damage to, or excessive wearing of, the stake.

3. A Method of Making a Slab on Grade Foundation

In still another of its aspects the present invention is embodied in a method of making a slab on grade foundation.

In the preferred method a foundation form is first assembled upon the surface of the earth. The form engages at and around its periphery a number of U"-shaped bent-planar members, the "U" of the member and the exterior surface of the form jointly creating and presenting a vertically oriented elongate aperture.

A number of first threaded stakes are then screwed substantially vertically into the earth though the vertically oriented elongate apertures as are situated periodically at convenient intervals around a periphery of the foundation form. Meanwhile, a number of second threaded stakes are screwed into the earth so as to proximately spatially intersect the first threaded stakes at regions above the earth.

A first assembly is adjustably located upon each first threaded substantially-vertical stake by, ultimately, a threaded affixation to the threads of the stake. Each first assembly serves to support a corresponding "U"-shaped bent-planar member, and through this corresponding member, the construction form, upon a first threaded stake. Each first assembly and associated bent planar member are thus used to temporarily locally join a first stake to the external circumference of the foundation form. The collective "U"-shaped bent-planar members and first assemblies collectively temporarily join the entire foundation form to the first stakes, temporarily suspending the foundation form level above the surface of the earth.

A second assembly located on and between both of each first threaded stake and its associated second threaded stake is used to temporarily join these stakes at a region above the surface of the earth. The collective action of the collective second assemblies collectively serves to directionally align the temporarily suspended foundation form to the surface of the earth.

Finally, a pourable construction material is poured into the foundation form so held and suspended and so directionally aligned in order to make a slab on grade foundation.

4. A Device for Connecting a Construction Form to Stakes

In still another of its aspects the present invention is embodied in a device for connecting a substantially horizontal elongate construction form having an elongate planar face and an opposite elongate "C"-channel with lips to a substantially vertical threaded stake.

The device includes a clip element in the substantial form of bent plane having a length and a cross section, orthogonal to an axis of the length, that is topologically equivalent to a "U" with a substantially central trough and two flanges. Each of the two flanges has at its furthest extent a feature that is complimentary to fit within, and to engage, the "C"-channel of the construction form. The clip element is slightly rotated in an imaginary horizontal axis so that the two flanges of its trough engage the "C"-channel of the construction form. When so engaged the clip element extends across the width of the "C"-channel, and the construction form of which the "C"-channel is a part.

A first nut screws upon the threaded stake. This nut has an external diameter smaller than the trough of the clip element. It may thus be semi-permanently left mounted upon the threaded stake, including during insertion of the threaded stake into and through the "U"-channel of the clip element.

A first, bar, element having an open-ended channel is side slipped over the threaded stake. The channel of this first bar element is larger than the diameter of the threaded stake but smaller than the external diameter of the first nut.

According to this arrangement, the first nut abutting the first bar element abutting a first end of the clip element's trough serves to locate and position this trough, and the clip element, along the substantially vertical threaded stake.

A second nut also screws upon the threaded stake. This nut again has an external diameter smaller than the trough of the clip element.

A second, connective, element having an open-ended channel again side slips over the threaded stake. The channel of this second bar element is larger than the diameter of the threaded stake but smaller than the external diameter of the second nut. The second nut abuts the second bar element which abuts a second end of the clip element's trough, serving to locate and position this trough, and the clip element, along the substantially vertical threaded stake in a position between the first nut/first bar element and the second nut/second bar element. The first and the second nuts can already be affixed to the threaded rod when the clip element is positioned about the threaded rod or, conversely, the clip element may be positioned about the threaded rod while the first and the second nuts are already affixed.

By this arrangement, the first, bar, element and the second, connective, element can both be side slipped about the threaded rod even when the clip element is already positioned about the threaded rod, and even when the first and the second nuts are already screwed upon the threaded rod.

Collectively in sequence, the clip element is first rotated into position, the threaded stake is then rotationally driven into the ground, then each of the first and the second nuts is screwed into position, and then each of the first and the second bar elements is slipped into position, so as to engage the threaded rod to the construction form.

5. A Skirt for a Construction Form

In still another of its aspects the present invention is embodied in a a skirt for an elongate construction form which construction form has an elongate planar face and an opposite elongate "C"-channel.

The preferred skirts are in the form of elongate members having and presenting at least one narrow edge. One embodiment is based on an elongate hollow member of triangular cross-section that is affixed at a narrow face surface to an exterior surface of one, correspondingly narrow, lip of the "C"-channel. So affixed it serves to extend the surface presented by the planar face of the form. Namely, when the construction form is used to define a reservoir into which is poured pourable building material, the skirt extends this form downwards.

Another embodiment of the skirt is as an elongate member of "L"-shaped cross section. This member is likewise affixed at its narrow face surface to an exterior surface of a one, correspondingly narrow, flange of the "C"-channel of the construction form. It likewise serves to extend the planar face of the construction form, when the construction form is used to define a reservoir into which is poured pourable building material, downwards, and also serves to extend the reservoir;

The advantage of the skirts of either triangular or "L"-shaped cross-section skirt is that they promote easy extraction of the construction form from hardened pourable construction material. Extraction is facilitated because the lowermost extension of the skirt of the construction form is either the apex of the triangle of the skirt of triangular cross section, or else the edge of the broad face surface of the skirt of "L"-shaped cross section. This apex, or this edge, is ineffective to stick within such hardened pourable construction material as has overflowed from the reservoir at the bottom of the skirt.

These and other aspects and attributes of the present invention will become increasingly clear upon reference to the following drawings and accompanying specification.

DESCRIPTION OF THE PREFERRED EMBODIMENT

Figure 1:
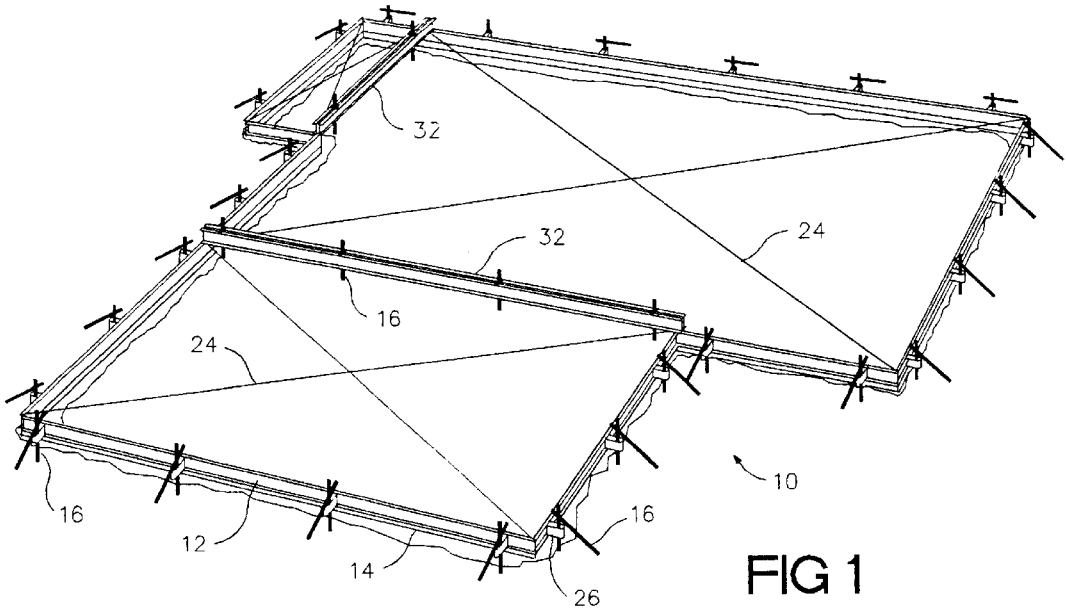
FIG. 1 shows a form in accordance with the present invention set up for forming a monolithic slab on grade.

In the following description, the following reference numerals in the drawings will be noted to correspond with the following elements"

10 Monolithic forming unit
12 Form member
14 Form skirt
16 Threaded stake
18 Nut, coarse thread
20 Hairpin bar
22 Kicker plate
24 Squaring wire
26 Slab clip
28 Clip flange
30 Extended edge
32 Overhead screed
34 Track section
36 Spacer block
38 Pin, with tapered tip
40 Connecting ring
42 Rivet, or equivalent
44 Clamping device
46 Corner
48 Folded body
50 Corner plate Commencing in drawings FIG. 1, a monolithic forming unit 10 is shown prior to placement of in-situ concrete for a slab-on-grade foundation. Foundation trenching is omitted for clarity. Forming unit 10 is made up of, and has geometry determined by, a plurality of components: a form member 12, an overhead screed 32, and a squaring wire 24. Specific lengths and relative positions of these linear elements define a required unique geometry of forming unit 10, for a given particular slab-on-grade foundation design. Permanent treatment of element surfaces to prevent adhesion of concrete, by use of compounds such as epoxy paint and hard wax, is beneficial to utility of unit 10, but is not necessary.

Each length of form 12 is most economically of a cold-rolled steel "C" section, such as would be used for a joist. This member may also be of another metal such as aluminum, or of plastic, and may be formed in any manner. The preferred cold-rolled joist type section may vary considerably in size and weight. A 200 mm (8") or 150 mm (6") deep member with 63 mm (2½) flanges of 1.5 mm (16 gage) steel is one appropriate section to use. If lighter weight is desired, 1.15 mm (18 gage) steel may be used with some loss of span capacity and durability. If light weight is very important for such things as relocating forming unit 10 intact, equivalent strength aluminum may be used at greater expense. In any case, it is important that the member be stiff enough to maintain accuracy (i.e., straightness) between intersecting geometry-defining members. If foundation particulars require, an optional skirt 14 may be attached below form 12, or depth of form 12 may be 250 mm (10") or greater to suit.

Support of forming unit 10 is by a number of a threaded stake 16 which screws directly into the ground. Connection of threaded stake 16 with any form 12 is via a slab clip 26. Support may be given to screed 32 directly with threaded stake 16. More specifics of these parts and methods are described below.

Figure 2:
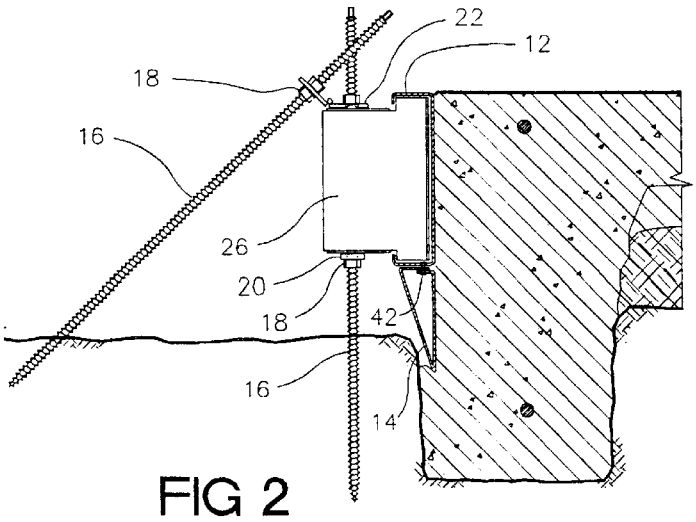
FIG. 2 shows a section view of a perimeter form in accordance with the present invention with an optional skirt affixed.

Continuing in drawings FIG. 2, a section view of form 12 after the placement of concrete shows one example of foundation perimeter construction. Many aspects of this construction detail may change to suit particular project circumstances. The top of form 12 defines the top surface of a concrete slab. Optional form skirt 14 is employed here to allow perimeter concrete vertical surface to be formed within and near a trench edge.

Figure 5:
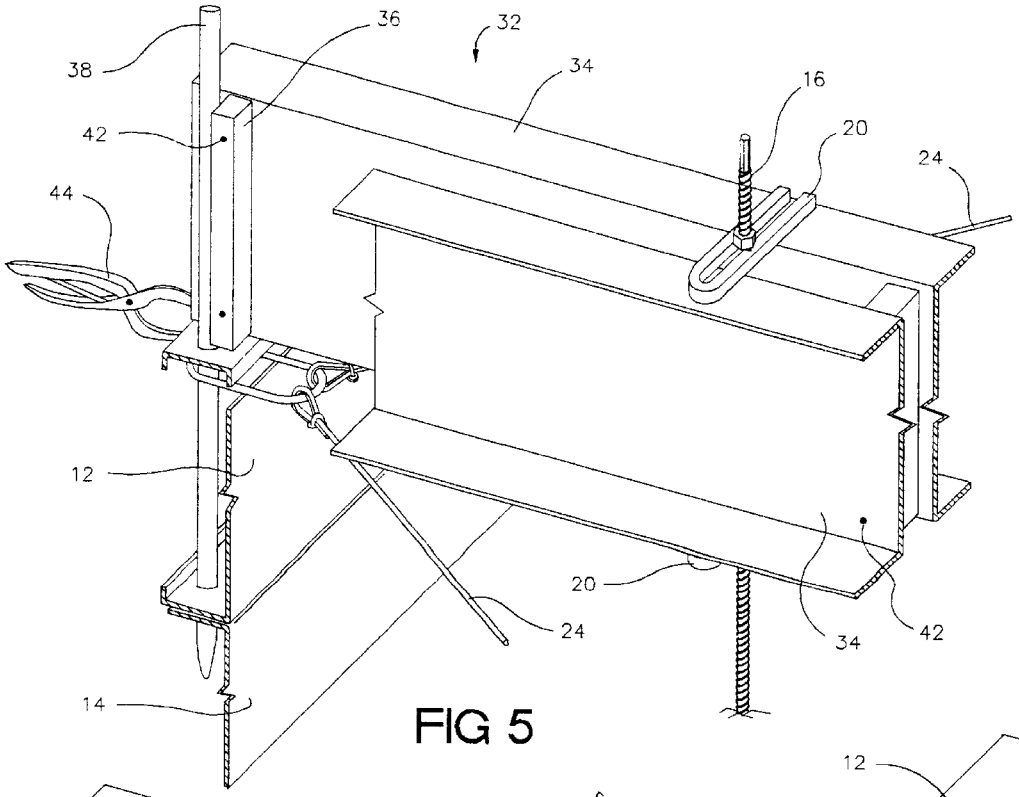
FIG. 5 shows overhead screed to perimeter form connection.
Figure 6:
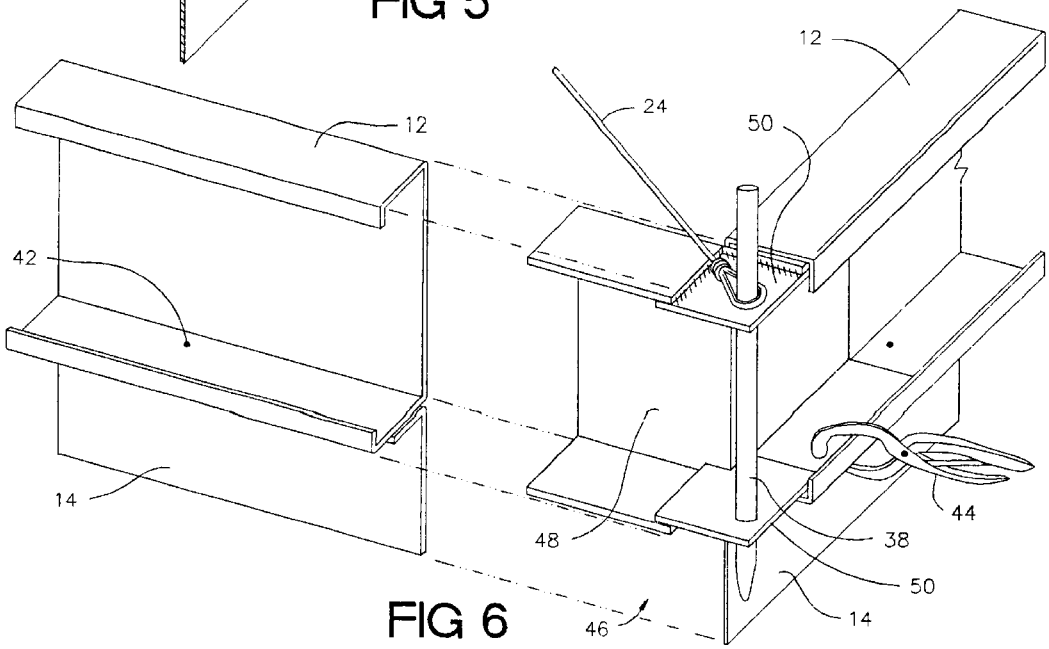
FIG. 6 shows a perimeter form corner.

The triangular shape of skirt 14 allows it to better sustain the cantilever loading from concrete forming and be made of lighter gage metal than the simple "L" section skirt 14' (of FIGS. 5 & 6). The triangular section also provides a tapered lower end, thus allowing easier removal from hardened concrete that has flowed around to the outside. The dimensions of skirt 14 may vary to suit construction needs. The maximum depth is really controlled by the strength of the total support of form 12 rather than the skirt itself. For most slab on grade situations, a depth of about 100 mm (4") is appropriate. The width at the top is about 38 mm (1.5"), but may vary considerably. A skirt of 0.848 mm (20 gage) steel material works fine, and an equivalent strength aluminum would be lighter weight. The interior may preferably be filled with an expanding adhesive type foam to give more surface support, and keep concrete, et cetera, out, and to improve durability of lighter gage metal. If skirt 14 is utilized, attachment to form 12 is with a number of a flush head rivet 42, or equivalent, as required.

Support to form 12 is provided by slab clip 26, which is fitted to the inside of form 12 "C" section. Clip 26 is supported by one, or most often two, of threaded stake 16. Stake 16, in conjunction with two of a nut 18, effectively clamps onto clip 26, thereby providing support.

Figure 2A:
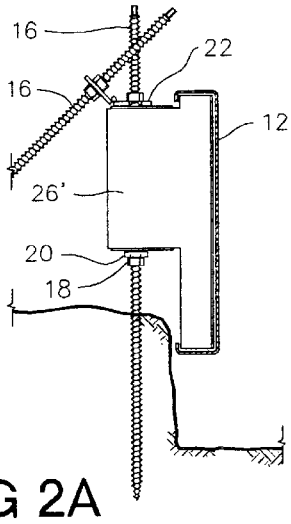
FIG. 2A shows a section view of the perimeter form in accordance with the present invention without the optional skirt.

Continuing in drawings FIG. 2A, an identical view as FIG. 2, but before concrete placement, is shown. FIG. 2A show use of form 12 without any type of skirt below. Because form 12 is a readily available, standardized, low-cost joist section, there is motivation to use it alone, and avoid the fabrication and attachment of skirt 14. For this use, form 12 would be as deep as required for vertical surface forming. This could be 200 mm (8"), 250 mm (10"), or 300 mm (12"), or to suit.

With this use of form 12, a modified slab clip 26' (Regular slab clip 26 is described in detail below.) would best have a deeper extension of lower elements which keep between face back-side and lower flange lip of form 12. This slab clip 26' could be described as having an offset body. This offset allows clearance between grade and slab clip 26' body, et cetera, when form 12 is set partially into a trench.

For most contemporary post-tension slab-on-grade construction, trenches are not utilized, and so geometry of regular slab clip 26 (FIG. 2) is suitable. However, a foundation contractor may have to alternate between either conventional or post-tension slab-on-grade construction, as contracts require. So, if skirt 14 is not desired, a modified slab 26' clip which suits either type of foundation construction is appropriate.

Figure 3:
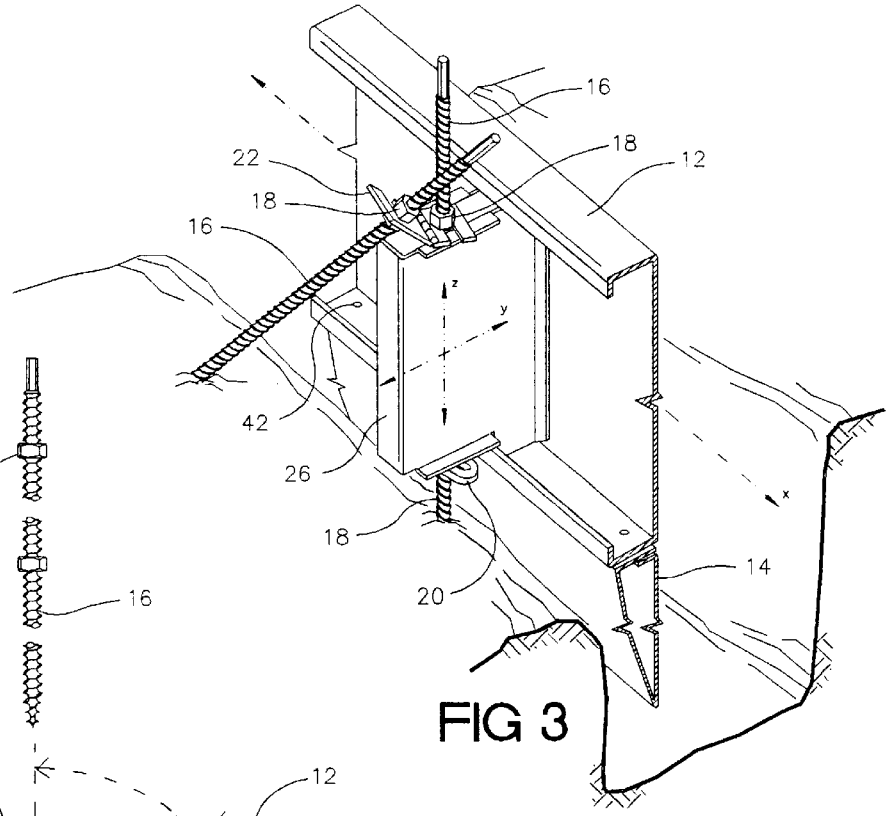
FIG. 3 shows form support components.

Continuing in drawings FIG. 3, the illustrated slab clip 26 is of folded sheet metal. A thickness of 1.81 mm (14 gage) steel is of adequate strength for prototypes, 2.58 mm (12 gage) is better for long term durability. Modified slab clip 26' (FIG. 2A) is better of 2.58 mm (12 gage) if its lower extensions are significant. The main body of clip 26 must easily allow the passage of stake 16 with nut 18. This is about 32 mm (1¼") clearance between wall elements in order to allow use of a 12 mm (½") diameter heavy hex body nut 18. Additional distance between sides of clip 26 can cause unwanted flexure of other connecting elements, and so should be avoided. The width of clip 26 must be enough to allow some adjustment of stake 16 location perpendicular to form 12 axis. This dimension may vary according to project requirements and form 12 section size, but a width of 125 mm (5") covers most applications. The height for clip 26 is that corresponding to form 12 section size, with a nominal dimension of about 150 mm (6"1) being a minimum practical height. Clip 26 has stiffening flanges at contact surfaces with support elements and with form 12 inside face. Top and bottom vertical extensions are sized to fit the inside of form 12 "C" section, providing slight clearance between form face back-side and flange stiffening lip, and between form top and bottom flanges.

Connection of clip 26 to stake 16 is made by the clamping pressure of a mutually opposed pair of nut 18. Nut bears against either a hairpin bar 20, or a kicker plate 22. Either of these elements serve to spread nut clamping force to both stiffened edges of clip 26 at opening for stake, and provide adequate friction at those edges to secure form 12 against in-situ concrete fluid pressure, et cetera.

Hairpin bar 20 is of either 9 mm (⅜") or 12 mm (½") square steel bar stock. It may be cold bent, and should be done so accurately about stake 16 diameter, so that the use of a washer is not required at nut 18. The finish length is unimportant, providing it spans the thickness of clip 26. The preferred length may be actually controlled by other embodiments of hairpin 20 not disclosed herein.

Kicker plate 22 is a steel hinge of heavy stock having a notch in each leg for purposes of insertion over threaded stake 16. Other embodiments of this device have been disclosed in an application pending. For this embodiment of kicker 22, the use of heavier hinge stock is structurally important due to the required amount of clamping force applied via nut 18, combined with the span across side walls of clip 26. Alternatively, the kicker 22 can be of normal weight hinge stock, with the leg that spans slab clip 26 reinforced with an attached hairpin 20.

Figure 4:
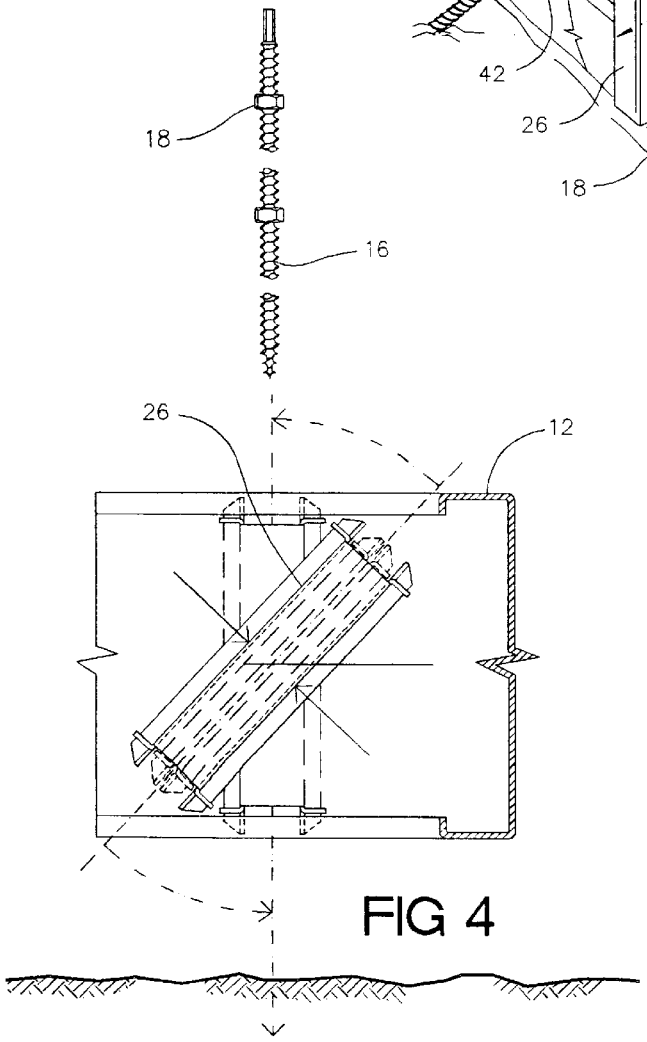
FIG. 4 shows threaded stake and slab clip interaction.

Continuing in drawings FIG. 4, the threaded stake 16 is of coarsely threaded rod material having a tapered-thread tip and a hex head, as disclosed previously for other embodiments. For an embodiment disclosed herein, where forms are lighter and stake 16 supports in-situ concrete fluid pressures directly, the parameters of successful design become more limited, so further discussion is warranted.

For threaded stake 16, the cut and pitch of the threads should be exaggerated over that of machine threads. Commercially available coil rod or lag bolt thread performs well in 12 mm (½") diameter, where the root diameter to outside diameter ratio is approximately 0.80 to 0.75. For larger diameters, this ratio becomes too large, and the threads must push relatively too much shank through the earth, and so may tend to strip rather than grab. If larger diameters are required, a specially manufactured thread would be preferable. A thread incline at the major diameter of at least 1 in 20, normally about 1 in 10, and more precisely 1 in 9.4 is appropriate for both the (i) soil and (ii) mechanical (i.e., nut) simultaneously made by the threaded stake 16.

The most economical commercially available stock material for threaded stakes 16 is coil rod. It is manufactured in 3.66 m (12') lengths and comes with loose cut coil-thread nuts designed to function even with debris and cement residue on the coil rod. Threaded stake lengths can be those suiting project requirements. Anything from about 0.45 m (1½') up to 1.8 m (6') can be practical depending upon soil conditions and forming requirements. The 12 mm (½") diameter coil rod which has 4.23 mm per thread (6 threads per inch) is the best coil rod size for functioning in common mixed soils. The lead end is preferably tapered to a point over at least a 18 mm (¾") length, with the taper generally (i) being contiguous and continuous to, and/or (ii) having approximately the same thread pitch, as do the rest of the rod's threads. The portion of stake driven into earth can be roughly 0.15 m to 0.6 m (six inches to two feet), depending upon soil firmness. A 9 mm (⅜") hex head would typically be machined or forged onto the same rod stock, while still allowing nuts to pass and thread on from the head end of the stake. Machining the preferred hexagonal head affords more latitude in head size because the thread cut may run through the hexagonal cut, permitting nuts to thread onto, as opposed to slip over, the head. According to this possible construction, the diameter of the head is spoken of as only be "effectively" smaller than is the root diameter of the threaded regions. A deep head of at least 25.4 mm (one inch) in length, fitting a deep socket, provides more durability for stakes of mild steel material Coil rod is available in harder steel, but the extra expense has not proven to be necessary.

A specially made, more exaggerated thread would be better grabbing than coil thread is, for a given length in earth. The pitch of coil thread cannot be exceeded, because of the mechanical requirements of connections to slab clip 26, et cetera, using those same threads. Thus far, the expense of a custom made thread has not been justifiable. Coil rod threaded stakes perform surprisingly well.

Continuing in drawings FIG. 5, a view of perimeter form 12 at a location where it intersects with overhead screed 32 is shown. This location is also where those same controlled-length linear elements meet specifically to create horizontal foundation geometry. To serve this purpose, form 12 and screed 32 function as compression strut elements, in conjunction with a pair of squaring wire 24 which maintain tension reactions for any rectangle of strut elements. All of these members are arranged to provide a two-dimensional statically-determinate structure. The length and fabrication of these members, including attachment of fixtures for placing foundation hardware, can be numerical control. Specific software for this purpose is appropriate, even if it is utilized solely for manual layout dimensions. Screed 32 may also be redundant to, or independent of, elements statically determining foundation geometry.

Squaring wire 24 may be adjusted to be taut when foundation geometry is correct. Wire clamps at connecting thimbles is the simplest device for this adjustment. Where multiple wires 24 tie into a single point, a connecting ring 40 is employed. Ring 40 requires only a minimal access slot to be made through form 12 surface, while providing simple connection to the outside of form 12. Ring 40 may be an adjustable u-bolt or the like, in lieu of the closed ring depicted.

A pin 38 is a 18 mm (¾") diameter steel rod, or the like, with a tapered lower end. The exact specification in unimportant. It may be identical to rods now conventionally used as form stakes. It provides mutual connection for horizontal linear elements at a point of intersection. A clamping device 44, such as a large opening locking plier normally used for holding pieces to be welded, which plier is trademarked as the "Vice Grip®" locking plier ("Vice Grip®" is registered trademark of Peterson Manufacturing Company), provides any necessary connection, vertically.

Overhead screed 32 is of two of a track section 34 connected at regular intervals with a spacer block 36. Each track section is that manufactured of cold-rolled steel for use in light-gage metal framing. A thickness of 1.44 mm (16 gage) steel is appropriate material for most screed 32 applications, but equivalent strength aluminum could be used to save weight. The flanges should be about 38 mm (1½"), and the height should be 150 mm (6") or 200 mm (8") , but these dimensions may vary considerably. Spacer blocks 36 are attached every 1.2 m (4') or so. They are of any material such as plastic, and attach with a plurality of a rivet type fastener 42, or the like. The terminal block is placed specifically to have screed 32 create the right foundation geometry when bearing against pin 38.

Note that overhead screed 32 depicted, may be replaced by a conventional screed placed within the plane of the slab, such as one of the existing products which then remain in place as control joints. The same role as a strut element in defining foundation geometry would apply to this type of screed member, if required.

Finally in FIG. 6, a corner 46 is shown with one form 12 on, and one form 12 off. Corner 46 is of 4.7 mm (3/16") steel or the like. It has a folded body 48 which is first bent into a channel section, then with flanges cut, is bent to the angle of the corner, usually 90 degrees. A corner plate 50 is welded on, top and bottom, for rigidity, and for locating pin 38. Corner 46 may be made for any angle. It is of mitered joint construction for body 48 flanges, in lieu of corner plates 50, for reverse angles.

Skirt 14 shown here is of the simple "L" shape. If it is employed, it is fastened on with a series of a flush-head rivet type fastener 42. Alternatively, it may be clamped in place with conventional clamping devices, such as those trade marked as "Vice Grip". It then may be of members having varied depths to suit site grade requirements, for projects not having a perfectly flat, graded pad.

In preparation of the forms system of the present invention as shown in FIG. 1, the foundation construction does not require the usual time consuming set up and squaring of layout strings, because monolithic forming unit 10 is internally collocating. Lower accuracy layout for foundation trenches may be performed with a triangulated layout diagram which references all foundation turning points off of two reference points. Ideally, any software which defines fabrication of all members of unit 10, would also provide this trench layout diagram. Most contemporary post tension slab on grade construction utilizes no trenches, so there is no need for any trenching layout. This method then provides added benefit, because with it, layout never has to be performed at all. Internally collocating unit 10 is simply set at an appropriate location, and is then used directly as a reference for plumbing, et cetera.

All of the foundation geometry defining members, such as forms 12, screeds 32, and squaring wires 24, may be assembled on the ground to create forming unit 10. It is then moved or adjusted into place, and supported with stakes 16 and slab clips 26. Final adjustment in any direction or rotation may occur after slab clip 26 supports are in place. Stake 16 supports at screed 32 should be set subsequent to making unit 10 location adjustments, because they may offer some unwanted resistance. Sliding connections at slab clips are secured when unit 10 location is approved.

Alternatively, these geometry defining members can be assembled while each is supported by one or two stakes 16 and one slab clip 26, near each end. For this method, stakes 16 are generally set with trench edges as a location reference. Lower nut 18 is then preset to a determined elevation. Thus, all forms 12 are initially set approximately at the right location individually. Slab clip 26 connections typically provide enough adjustment to still support forms 12 after adjustment into exact location as unit 10, without removal and replacement of stakes. As forms 12, screeds 32, and squaring wires 24 are interconnected, internal collocation of unit 10 occurs, while it is floating on supports.

All forms 12, screeds 32, and wires 24 have mirror-identical connections at either end, thus the assembly of unit 10 may be accomplished to suit a mirrored version of any particular foundation design, by switching the members corresponding to each end of a given member. Original vertical orientation of all members may be maintained.

Squaring wires 24 can be removed anytime after forms 12 making up unit 10 have been secured into position at slab clips 26, as described below. Wires 24 have performed their function of geometry definition, and so removal may be undertaken before placement of concrete. Alternatively, wires 24 may be left in place for redundant definition of geometry during the period of concrete placement, when loads to forms 12 are highest and least predictable. Wires would then be removed immediately after concrete is placed and screeded off flush, and before any other surface finishing is performed on the concrete. For those preferring some other method of squaring forms, use of wires 24 is optional.

Continuing in FIGS. 2 & 2A, the perimeter section view therein of a monolithic concrete pour illustrates basic structural support of form 12 against fluid concrete pressure. Vertical stake 16 accepts vertical and some horizontal forces, while sloped stake 16 provides buttress support for horizontal forces. Attachment to slab clip 26 is by mutual tightening of opposing nuts 18 on vertical stake. Form 12 is thus provided with all necessary support to allow a light-gage steel member to be utilized for foundation forming purposes. Removal of form 12, and skirt 14 if utilized, may occur anytime after solidification of concrete. Taper of skirt 14 assists removal when concrete has flowed outside the bottom edge, and hardened.

Continuing in FIG. 3, the view of the form 12 support shown therein reveals mechanical attributes of support components. In particular, the ease of adjustment to form 12 or unit 10, in any direction, at any time after support stakes 16 are set is illustrated.

Vertical stake 16 may be left with upper nut 18 loose while sloped stake has its corresponding nuts tightened about kicker plate 22. Thus, a stable, triangulated-support structure is created, while allowing form 12 or unit 10 to be slid horizontally along the y axis of slab clip 26 indicated. Adjustment along the horizontal x axis occurs by passing form 12, along its major axis, over slab clip 26. This movement is controlled by placement of, and connection to, a perpendicular form 12, which has its own slab clip 26 adjustable support. Horizontal rotation of entire unit 10 is possible with all stakes in place, because with vertical stake 16 upper nuts 18 loosened, movement in any horizontal direction is possible at all stake locations simultaneously.

Vertical adjustment is achieved separately of horizontal. The best procedure is to set the lower nuts to proper elevation with a preferred leveling device on vertical stakes before making any connections. Then, after all horizontal adjustments are performed, any required slight vertical adjustments are undertaken by adjustment of those nuts at the same time they are tightened against upper nuts. Considerable vertical adjustment requires loosening and adjustment of sloped stake nuts about kicker plate 22 simultaneously with adjustment of nuts on vertical stake.

Continuing in FIG. 4, an assemblage of stake 16 and slab clip 26 support to form 12 is illustrated. In the general case, slab clip 26 is secured to form 12 before stake 16 is employed.

Slab clip 26 may slide in from an end of form 12, but typically is inserted into form at any point from behind. Clip 26 is rotated into place in order to clear form stiffening lips. It is simultaneously squeezed to clear between form 12 upper and lower flanges as it is rotated to the perpendicular of form 12. As clip 26 springs back to its usual geometry, it remains secured to form 12 while being free to slide along the form length. Any number of clips 26 may be left on form 12 as it is taken from project to project. Stake 16 is then threaded into the earth through slab clip 26. Note that clip 26 does not need to be entirely vertical to function, allowing some latitude for driving stake 16. The preferred means of driving it is a pneumatic impact wrench of having a variable speed up to at least 6000 RPM and having a rated torque of at least 271 N*m (200 ft*lb).

Continuing in FIG. 5, the illustrated assembly of members making up monolithic forming unit 10 is easy. Connecting ring 40 passes through slot in face of form 12, and is initially barely pinned by the lower tapered end of pin 38. Overhead screed 32 is set into place. Pin 38 is then manipulated down so that lower end inserts into hole in form 12 lower flange. Resulting lever action serves to tighten squaring wire 24. Pin 38 acts as stop for terminal spacer block 36, thereby utilizing screed 32 as a strut element defining foundation geometry. Direct support at screed 32 performed by stake 16 and hairpin bar 20, is generally made subsequent to support and adjustment of forms described above.

Lower flange of each track 34 making up overhead screed 32 is used as screed guiding surface, in the same manner as the top of form 12 is used in defining a top of a concrete slab. Screed 32 is removed almost immediately after placement and screeding off of concrete, and before any concrete finish work begins. If wires 24 have been left in place for concrete placement, then they can be removed simultaneously with screed 32.

Finally in FIG. 6, the outside corner 46 of monolithic forming unit is connected by slipping form 12 end over folded body 48 of corner 46. Pin 38 acts as a lever tightener for wire 24 as lower end is brought toward, and into, the hole in lower corner plate 50. Optional clamping device 44 provides redundant connection, since squaring wire 24 keeps assemblage intact.

In the system of the invention as shown in all Figures, removal of pins 38 and wires 24 begins disassembly process. This may be occur before, or immediately after, concrete placement. Screeds can be removed at the time which best facilitates concrete slab surface finishing. Nuts 18 are minimally loosened to free hairpins 20 and kicker plates 22, which frees screeds and/or slab clips 26 and forms 12. In distinct contrast to conventional stakes, threaded stakes 16 remove quickly and easily.

A summary of the ramifications and scope of the present invention is as follows. The concrete slab forming system of the invention completely eliminates the most prevalent difficulties in foundation construction. It does not require complex, unwieldy supporting hardware, as previous attempts at providing form location adjustment have. This simple method utilizes elements having a cost equivalent to conventional boards and stakes, yet it provides sophistication which saves substantial amounts of labor and improves foundation quality. Benefit is considerable for one unit. Aggregate benefit is enormous for repeated identical and mirrored units. Because of the repeatable foundation accuracy, the use of increasingly popular light gage structure framing is expedited, particularly for 'panelized' construction. The method of the invention both simplifies, and optimizes the accuracy of, the foundation forming process.

Although the description above contains many specificities, these should not be construed as limiting the scope of the intention, but merely as providing illustration of the preferred embodiments. For example, the threaded stake 16 and slab clip 26 method of form support provides utility independently of slab-on-grade construction. These components provide considerable benefit for free standing foundation walls, or sidewalk and curb construction, et cetera. The threaded stake 16 in particular, has proven to provide enormously versatile utility in concrete forming, with almost limitless applications.

In accordance with the preceding explanation, variations and adaptations of the concrete slab forming system in accordance with the present invention will suggest themselves to a practitioner of the construction method and material arts.

In accordance with these and other possible variations and adaptations of the present invention, the scope of the invention should be determined in accordance with the following claims, only, and not solely in accordance with that embodiment within which the invention has been taught.

I claim:

1. A device for connecting a substantially horizontal elongate construction form having an elongate planar face and an opposite elongate "C"-channel with lips to a substantially vertical threaded stake, the device comprising:

a clip element in the substantial form of bent plane having a length and a cross section, orthogonal to an axis of the length, that is topologically equivalent to a "U" with a substantially central trough and two flanges, each of the two flanges having at their furthest extent a feature that is complimentary to fit within, and to engage, the "C"-channel of the construction form so that the clip element extends across the width of the "C"-channel, and the construction form of which the "C"-channel is a part;

a first bar element having an open-ended channel for side slipping over the threaded stake, the first bar element's channel being larger than the diameter of the threaded stake;

a first nut screwing upon the threaded stake, the first nut having an external diameter smaller than the trough of the clip element but larger than the channel of the first bar element;

wherein the first nut abutting the first bar element abutting a first end of the clip element's trough serves to locate and position this trough, and the clip element, along the substantially vertical threaded stake;

a second nut screwing upon the threaded stake, the second nut also having an external diameter smaller than the trough of the clip element;

a second bar element having an open-ended channel for side slipping over the threaded stake, the second bar element's channel being larger than the diameter of the threaded stake but smaller than the external diameter of the second nut;

wherein the second nut abutting the second bar element abutting a second end of the clip element's trough serves to locate and position this trough, and the clip element, along the substantially vertical threaded stake in position between the first nut/first bar element and the second nut/second bar element;

wherein the first and the second nuts can already be affixed to the threaded stake when the clip element is positioned about the threaded stake, therein being in nearly suitable positions to later cooperate in supporting the clip element;

wherein the first and the second bar elements can be side slipped about the threaded stake even when the clip element is already positioned about the threaded stake, and the first and the second nuts are already screwed upon the threaded stake;

wherein, by room in its trough to accommodate the vertical threaded stake that passes therethrough, the clip element can be slightly rotated in a horizontal axis so that the two flanges of its trough engage the "C"- channel of the construction form even while the clip element is already positioned about the threaded stake;

wherein the clip element rotates into position, each of the first and the second nuts screw into positions, and each of the first and the second bar elements slip into positions, so as to engage the threaded stake to the construction form.

2. The device according to claim 1 extended and expanded to engage a second threaded stake that is positioned proximately to the first threaded stake at the region of the second bar element, wherein the extended and expanded device the second bar element, in addition to an open-ended first channel for side slipping over the first threaded stake, further comprises:

a second channel for side slipping over the second threaded stake.

3. The extended and expanded device according to claim 1 wherein the second bar element comprises:

a first region having and defining the open-ended first channel;

a second region having and defining the open-ended second channel; and a hinge connecting the first and the second regions.

4. A skirt for an elongate construction form having an elongate planar face and an opposite elongate "C"-channel, the skirt comprising:

a triangular cross-section elongate hollow member affixed at a narrow face surface to an exterior surface of one, correspondingly narrow, flange of the "C"-channel so as to extend downwards while so affixed a surface presented by a planar face of the construction form, therein enlarging downwards a reservoir defined by the construction form into which reservoir is poured pourable building material;

wherein extraction of the construction form from hardened pourable construction material is facilitated because the lowermost extension of the form is the but an apex of the triangular cross-section elongate hollow member affixed as a skirt, and this edge is ineffective to stick within such hardened pourable construction material as has overflowed from the reservoir at the bottom of the member.

5. The skirt according to claim 4 wherein the elongate hollow member is of right triangular cross section, and is affixed at its narrow face surface to the exterior surface the correspondingly narrow flange of the "C"-channel so as to extend in a plane the surface presented by the planar face of the construction form when the construction form is used to define a reservoir into which is poured pourable building material.

6. The skirt according to claim 4 wherein the elongate hollow member comprises:

a steel exterior; and a filling of a material other than metal.

7. The skirt according to claim 4 wherein the elongate hollow member's filling comprises:

foam.

8. A skirt for an elongate construction form having an elongate planar face and an opposite elongate "C"-channel, the skirt comprising:

an elongate member of "L"-shaped cross section affixed at its narrow face surface to an exterior surface of a one, correspondingly narrow, flange of the "C"-channel of the construction form, therein serving to extend the planar face of the construction form, when the construction form is used to define a reservoir into which is poured pourable building material, downwards and therein also serving to extend the reservoir;

wherein extraction of the construction form from hardened pourable construction material within the reservoir is facilitated because the lowermost extension of the form is but an edge of a broad face surface of the elongate member of "L"-shaped cross section, and this edge is ineffective to stick within such hardened pourable construction material as has overflowed from the reservoir at the bottom of the member.

9. A device for connecting a substantially horizontal elongate construction form having an elongate planar face and an opposite elongate "C"-channel with lips to a substantially vertical stake with external surface features, the device comprising:

a clip element in the substantial form of bent plane having a length and a cross section, orthogonal to an axis of the length, and a substantially central trough and two flanges, each of the two flanges having at their furthest extent a feature that is complimentary to fit within, and to engage, the "C"-channel of the construction form so that the clip element extends across the width of the "C"-channel, and the construction form of which the "C"-channel is a part;

a first bar element having an open-ended channel for side slipping over the threaded stake, the first bar element's channel being larger than the diameter of the threaded stake;

a first fastener selectively engaging the surface features of the stake so as to hold position along the length of the stake, the first fastener having an external diameter smaller than the trough of the clip element but larger than the channel of the first bar element;

wherein the first fastener abutting the first bar element abutting a first end of the clip element's trough serves to locate and position this trough, and the clip element, along the substantially vertical stake;

a second fastener selectively engaging the surface features of the stake so as to hold position along the length of the stake, the second fastener also having an external diameter smaller than the trough of the clip element but larger than the channel of the first bar element;

a second bar element having an open-ended channel for side slipping over the stake, the second bar element's channel being larger than the diameter of the stake but smaller than the external diameter of the second fastener;

wherein the second fastener abutting the second bar element abutting a second end of the clip element's trough serves to locate and position this trough, and the clip element, along the substantially vertical stake in position between the first fastener/first bar element and the second fastener/second bar element;

wherein the first and the second fasteners can already be affixed to the stake when the clip element is positioned about the stake, therein being in nearly suitable positions to later cooperate in supporting the clip element;

wherein the first and the second bar elements can be side slipped about the stake even when the clip element is already positioned about the stake, and the first and the second fasteners are already positioned along and upon the stake;

wherein, by room in its trough to accommodate the vertical stake that passes therethrough, the clip element can be slightly rotated in a horizontal axis so that the two flanges of its trough the "C"-channel of the construction form even while the clip element is already positioned about the stake;

wherein the clip element rotates into position, each of the first and the second fasteners assume positions, and each of the first and the second bar elements slip into positions, so as to engage the stake to the construction form.

* * * * *